US008828220B2

(12) United States Patent
Gordon

(10) Patent No.: US 8,828,220 B2
(45) Date of Patent: Sep. 9, 2014

(54) UPGRADING OF PETROLEUM OIL FEEDSTOCKS USING ALKALI METALS AND HYDROCARBONS

(75) Inventor: John Howard Gordon, Salt Lake City, UT (US)

(73) Assignee: Ceramatec, Inc., Salt Lake City, UT (US)

( * ) Notice: Subject to any disclaimer, the term of this patent is extended or adjusted under 35 U.S.C. 154(b) by 482 days.

(21) Appl. No.: 12/916,984

(22) Filed: Nov. 1, 2010

(65) Prior Publication Data

US 2011/0100874 A1 May 5, 2011

Related U.S. Application Data

(60) Provisional application No. 61/257,369, filed on Nov. 2, 2009.

(51) Int. Cl.

| | |
|---|---|
| ***C10G 17/00*** | (2006.01) |
| ***C10G 50/00*** | (2006.01) |
| ***C25C 1/22*** | (2006.01) |
| ***C10G 29/04*** | (2006.01) |

(52) U.S. Cl.

CPC ..... *C25C 1/22* (2013.01); *C10G 2300/205* (2013.01); *C10G 2300/202* (2013.01); *C10G 50/00* (2013.01); *C01G 2300/1088* (2013.01); *C10G 2300/1025* (2013.01); *C10G 29/04* (2013.01); *C10G 2300/1081* (2013.01)

USPC ..... 208/177; 208/208 M

(58) Field of Classification Search

USPC ..... 208/97, 284, 287, 208 M

See application file for complete search history.

(56) References Cited

U.S. PATENT DOCUMENTS

| | | | |
|---|---|---|---|
| 1,501,756 | A | 7/1924 | Downs |
| 2,836,633 | A | 5/1958 | Esmay |
| 3,497,569 | A | 2/1970 | Stiles et al. |
| 3,785,965 | A | 1/1974 | Welty |
| 3,787,315 | A | 1/1974 | Bearden, Jr. et al. |

(Continued)

FOREIGN PATENT DOCUMENTS

| | | |
|---|---|---|
| WO | WO-02099013 | 12/2002 |
| WO | WO-2010124030 | 10/2010 |
| WO | WO-2011012900 | 2/2011 |

OTHER PUBLICATIONS

Sternberg, Heinz W.; Delle Donne, Charles L.;Pantages, Peter, Solubilization of coal via reductive alkylation, Preprints of Papers—American Chemical Society, Division of Fuel Chemistry (1970), 14(1), 87-94 (available to the public 1984) CODEN: ACFPAI; ISSN: 0569-3772.*

(Continued)

*Primary Examiner* — Randy Boyer
*Assistant Examiner* — Juan Valencia
(74) *Attorney, Agent, or Firm* — David Fonda

(57) ABSTRACT

A method of upgrading an oil feedstock by removing heteroatoms and/or one or more heavy metals from the oil feedstock composition. This method reacts the oil feedstock with an alkali metal and an upgradant hydrocarbon. The alkali metal reacts with a portion of the heteroatoms and/or one or more heavy metals to form an inorganic phase separable from the organic oil feedstock material. The upgradant hydrocarbon bonds to the oil feedstock material and increases the number of carbon atoms in the product. This increase in the number of carbon atoms of the product increases the energy value of the resulting oil feedstock.

17 Claims, 3 Drawing Sheets

(56) References Cited

U.S. PATENT DOCUMENTS

| | | | | |
|---|---|---|---|---|
| 3,788,978 | A | 1/1974 | Bearden, Jr. et al. | |
| 3,791,966 | A | 2/1974 | Bearden | |
| 3,960,708 | A | 6/1976 | McCollum et al. | |
| 4,076,613 | A | 2/1978 | Bearden, Jr. | |
| 4,428,828 | A | 1/1984 | Bose | |
| 5,328,577 | A * | 7/1994 | Murphy | 204/168 |
| 5,695,632 | A | 12/1997 | Brons et al. | |
| 5,750,814 | A | 5/1998 | Grootjans et al. | |
| 5,935,419 | A | 8/1999 | Khan et al. | |
| 5,935,421 | A | 8/1999 | Brons et al. | |
| 6,210,564 | B1 * | 4/2001 | Brons et al. | 208/208 M |
| 6,280,128 | B1 | 8/2001 | Schrader | |
| 6,368,486 | B1 | 4/2002 | Thompson et al. | |
| 6,413,898 | B1 | 7/2002 | Faber et al. | |
| 6,635,795 | B2 | 10/2003 | Gislason et al. | |
| 6,706,902 | B2 | 3/2004 | Sturmann et al. | |
| 6,734,133 | B1 | 5/2004 | Weisbeck et al. | |
| 6,787,019 | B2 | 9/2004 | Jacobson et al. | |
| 7,897,028 | B2 | 3/2011 | Gordon et al. | |
| 8,088,270 | B2 | 1/2012 | Gordon et al. | |
| 2002/0125175 | A1 | 9/2002 | Collins et al. | |
| 2005/0145545 | A1 * | 7/2005 | Schucker | 208/208 M |
| 2005/0161340 | A1 | 7/2005 | Gordon et al. | |
| 2006/0054538 | A1 | 3/2006 | Hsu et al. | |
| 2006/0138029 | A1 | 6/2006 | Malek et al. | |
| 2007/0087934 | A1 | 4/2007 | Martens et al. | |
| 2008/0031792 | A1 | 2/2008 | Ciccarelli et al. | |
| 2009/0134040 | A1 | 5/2009 | Gordon et al. | |
| 2009/0259082 | A1 | 10/2009 | Deluga et al. | |
| 2010/0089762 | A1 | 4/2010 | Gordon | |
| 2010/0155298 | A1 | 6/2010 | Raterman et al. | |
| 2010/0297531 | A1 | 11/2010 | Liu et al. | |
| 2010/0297537 | A1 | 11/2010 | Coors et al. | |
| 2010/0304953 | A1 | 12/2010 | Liu et al. | |
| 2011/0054232 | A1 * | 3/2011 | Sangar et al. | 585/417 |
| 2011/0119994 | A1 | 5/2011 | Hogendoorn et al. | |
| 2011/0155647 | A1 | 6/2011 | Serban et al. | |
| 2012/0304530 | A1 | 12/2012 | Chitta et al. | |
| 2013/0043160 | A1 | 2/2013 | Gordon | |
| 2013/0140217 | A1 | 6/2013 | Gordon et al. | |
| 2013/0153469 | A1 | 6/2013 | Gordon | |

OTHER PUBLICATIONS

Natural Gas, http://www.gasenergia.com.br/portal/ing/gasnatural/dadostecnicos.jsp (Jun. 10, 2004), 20 pages.*

Yu, Jianfei et al., "High temperature naphthenic acid corrosion of steel in high TAN refining media", *Anti-Corrosion Methods and Materials*, vol. 55 Issue 5, (2008),257-63.

Wang, Chen et al., "High Temperature Naphthenic Acid Corrosion of Typical Steels", *Canadian Journal on Mechanical Sciences and Engineering* vol. 2, No. 2 (Feb. 1, 2011),23-30.

Seo, Sang Y., "International Search Report", PCT App. No. PCT/US2012/046939 (Corresponding to U.S. Appl. No. 13/550,313), (Jan. 31, 2013),1-3.

Seo, Sang Y., "Written Opinion of the International Searching Authority", PCT. App. No. PCT/US2012/046939 (Corresponding to U.S. Appl. No. 13/550,313), (Jan. 31, 2013),1-6.

Reggel, et al., "Desulphurization of Gasoline by Metallic Sodium", *Fuel*, vol. 55, (Jul. 1976),170-172.

Byun, Sang H., "International Search Report", International Search Report for PCT US 2010/054984 (Corresponding to U.S. Appl. No. 12/916,984), (Jul. 28, 2011),1-3.

Byun, Sang H., "Written Opinion of the International Searching Authority", Written Opinion for PCT US 2010/054984 (Corresponding to U.S. Appl. No. 12/916,984), (Jul. 28, 2011),1-5.

Kabe, T. et al., "Hydrodesulfurization and Hydrodenitrogenation", *Wiley-VCH* (1999),110-112.

Task Force on Strat. Uncnv. Fuel, "America's Strategic Unconventional Fuels, vol. III Resource and Technology Profiles", *America's Strategic Unconventional Fuels, vol. III Resource and Technology Profiles* (completed Feb. 2007, Published Sep. 2007)., Full text available at http://www.unconventionalfuels.org/publications/reports/Volume_III_ResourceTechProfiles(Final).pdf,(Sep. 2007),III-25.

Lee, Young W., "International Search Report", PCT/US/2012/039388 (corresponding to U.S. Appl. No. 12/916,948), (Dec. 27, 2012),1-3.

Lee, Young W., "Written Opinion of the International Searching Authority", PCT/US/2012/039388 (corresponding to U.S. Appl. No. 12/916,948), (Dec. 27, 2012),1-3.

Lee, Dong W., "International Search Report", PCT/US2013/023850 (Corresponding to U.S. Appl. No. 13/753,918), (May 14, 2013),1-3.

Lee, Dong W., "Written Opinion of the International Searching Authority", PCT/US2013/023850 (Corresponding to U.S. Appl. No. 13/753,918), (May 14, 2013),1-5.

Hwang, Yun K., "International Search Report", PCT App. No. PCT/US2012/065670 (corresponding to U.S. Appl. No. 13/679,696), (Apr. 1, 2013),1-4.

Hwang, Yun K., "Written Opinion of the International Searching Authority", PCT App. No. PCT/US2012/065670 (corresponding to U.S. Appl. No. 13/679,696), (Apr. 1, 2013),1-8.

Lee, Dong W., "International Search Report", PCT Application No. PCT/US1350194 (Corresponding to U.S. Appl. No. 13/940,336), (Nov. 5, 2013),1-5.

Lee, Dong W., "Written Opinion of the International Searching Authority", PCT Application No. PCT/US1350194 (Corresponding to U.S. Appl. No. 13/940,336), (Nov. 5, 2013),1-5.

Lee, Dong W., "International Search Report", PCT Application No. PCT/US2013/026698 (Corresponding to U.S. Appl. No. 13/770,610), (Aug. 19, 2013),1-5.

Lee, Dong W., "Written Opinion of the International Searching Authority", PCT Application No. PCT/US2013/026698 (Corresponding to U.S. Appl. No. 13/770,610), (Aug. 19, 2013),31-5.

* cited by examiner

UPGRADING OF PETROLEUM OIL FEEDSTOCKS USING ALKALI METALS AND HYDROCARBONS

RELATED APPLICATION

This application claims the benefit of U.S. Provisional Patent Application Ser. No. 61/257,369 filed Nov. 2, 2009, entitled "Upgrading of Petroleum Oil Feedstocks Using Alkali Metals and Hydrocarbons." This provisional application is expressly incorporated herein by reference.

U.S. GOVERNMENT INTEREST

This invention was made with government support under Contract No. DE-FE0000408 awarded by the U.S. Department of Energy. The government has certain rights in the invention.

TECHNICAL FIELD

The present disclosure relates to a process for removing nitrogen, sulfur, and heavy metals from sulfur-, nitrogen-, and metal-bearing shale oil, bitumen, or heavy oil so that these materials may be used as a hydrocarbon fuel. More specifically, the present disclosure relates to removing nitrogen, sulfur, and heavy metals from shale oil, bitumen, or heavy oil while at the same time, upgrading these materials to have a higher hydrogen-to-carbon ratio.

BACKGROUND

The demand for energy (and the hydrocarbons from which that energy is derived) is continually rising. However, hydrocarbon raw materials used to provide this energy often contain difficult-to-remove sulfur and metals. For example, sulfur can cause air pollution and can poison catalysts designed to remove hydrocarbons and nitrogen oxide from motor vehicle exhaust, necessitating the need for expensive processes used to remove the sulfur from the hydrocarbon raw materials before it is allowed to be used as a fuel. Further, metals (such as heavy metals) are often found in the hydrocarbon raw materials. These heavy metals can poison catalysts that are typically utilized to remove the sulfur from hydrocarbons. To remove these metals, further processing of the hydrocarbons is required, thereby further increasing expenses.

Currently, there is an on-going search for new energy sources in order to reduce the United States' dependence on foreign oil. It has been hypothesized that extensive reserves of shale oil, which constitutes oil retorted from oil shale minerals, will play an increasingly significant role in meeting this country's future energy needs. In the U.S., over 1 trillion barrels of usable, reserve shale oil are found in a relatively small area known as the Green River Formation located in Colorado, Utah, and Wyoming. As the price of crude oil rises, these shale oil resources become more attractive as an alternative energy source. In order to utilize this resource, specific technical issues must be solved in order to allow such shale oil reserves to be used, in a cost effective manner, as hydrocarbon fuel. One issue associated with these materials is that they contain a relatively high level of nitrogen, sulfur and metals, which must be removed in order to allow this shale oil to function properly as a hydrocarbon fuel.

Other examples of potential hydrocarbon fuels that likewise require a removal of sulfur, nitrogen, or heavy metals are bitumen (which exists in ample quantities in Alberta, Canada) and heavy oils (such as are found in Venezuela).

The high level of nitrogen, sulfur, and heavy metals in oil sources such as shale oil, bitumen and heavy oil (which may collectively or individually be referred to as "oil feedstock") makes processing these materials difficult. Typically, these oil feedstock materials are refined to remove the sulfur, nitrogen and heavy metals through processes known as "hydro-treating" or "alkali metal desulfurization."

Hydro-treating may be performed by treating the material with hydrogen gas at elevated temperature and an elevated pressure using catalysts such as Co—Mo/$Al_2O_3$ or Ni—Mo/$Al_2O_3$. Disadvantages of hydro-treating include over saturation of organics where double bonds between carbon atoms are lost and fouling of catalysts by heavy metals which reduces the effectiveness of hydro-treating. Additionally hydro-treating requires hydrogen, which is expensive.

Alkali metal desulfurization is a process where the oil feedstock is mixed with an alkali metal (such as sodium or lithium) and hydrogen gas. This mixture is reacted under pressure (and usually at an elevated temperature). The sulfur and nitrogen atoms are chemically bonded to carbon atoms in the oil feedstocks. At an elevated temperature and elevated pressure, the reaction forces the sulfur and nitrogen heteroatoms to be reduced by the alkali metals into ionic salts (such as $Na_2S$, $Na_3N$, $Li_2S$, etc.). To prevent coking (e.g., a formation of a coal-like product) however, the reaction typically occurs in the presence of hydrogen gas which is expensive.

Another downside to processes requiring hydrogen in oil feedstock upgrading is that the source of hydrogen is typically formed by reacting hydrocarbon molecules with water using a steam methane reforming process which produces carbon dioxide emissions. This production of carbon dioxide during the hydro-treating process is considered problematic by many environmentalists due to rising concern over carbon dioxide emissions and the impact such emissions may have on the environment.

An additional problem in many regions is the scarcity of water resources needed to create the hydrogen. For example, in the region of Western Colorado and Eastern Utah where parts of the Green River Formation of shale oil is located, the climate is arid and the use of water in forming hydrogen gas can be expensive.

Thus, while conventional hydro-treating or alkali metal desulfurization processes are known, they are expensive and require large capitals investments in order to obtain a functioning plant and can have adverse environmental effects. There is a need in the industry for a new process that may be used to remove heteroatoms such as sulfur and nitrogen from oil feedstocks, but that is less expensive and more environmentally friendly than conventional processing methods. Such a process is disclosed herein.

SUMMARY

The present embodiments include a method of upgrading an oil feedstock. The method comprises obtaining a quantity of an oil feedstock, the oil feedstock comprising at least one carbon atom and a heteroatom and/or one or more heavy metals. In one embodiment, the quantity of the oil feedstock is reacted with an alkali metal and an upgradant hydrocarbon. The upgradant hydrocarbon may include at least one carbon atom and at least one hydrogen atom. The alkali metal reacts with the heteroatom and/or the heavy metals to form one or more inorganic products. The upgradant hydrocarbon reacts with the oil feedstock to produce an upgraded oil feedstock, where the number of carbon atoms in the upgraded oil feedstock is greater than the number of carbon atoms in the oil feedstock. The inorganic products are then separated from the upgraded oil feedstock. The reaction of the oil feedstock, the alkali metal, and the upgradant hydrocarbon molecule may be implemented without using hydrogen gas.

In some embodiments, the alkali metal comprises lithium, sodium and/or alloys of lithium and sodium. The upgradant hydrocarbon may comprise natural gas, shale gas and/or mixtures thereof. In other embodiments, the upgradant hydrocarbon comprises methane, ethane, propane, butane, pentane, ethene, propene, butene, pentene, dienes, isomers of the forgoing, and/or mixtures thereof. The reaction may occur at a pressure that is between about 250 and about 2500 psi and/or at a temperature that is between room temperature and about 450° C. In other embodiments, the reaction occurs at a temperature that is above the melting point of the alkali metal but is lower than 450° C. In other embodiments, the reaction occurs at a temperature ranging between about 150° C. and about 450° C. Further embodiments may utilize a catalyst in the reaction. The catalyst may comprise molybdenum, nickel, cobalt or alloys thereof, molybdenum oxide, nickel oxide or cobalt oxides and combinations thereof.

The separation used in the process may occur in a separator, wherein the inorganic products form a phase that is separable from an organic phase that comprises the upgraded oil feedstock and/or unreacted oil feedstock. To facilitate this separation, a flux may be added to the separator. After separation, the alkali metal from the inorganic products may be regenerated and reused.

The upgraded oil feedstock produced in the reaction may have a greater hydrogen-to-carbon ratio than the oil feedstock. The upgraded oil feedstock produced in the reaction may also have a greater energy value than the oil feedstock. Further, the heteroatom-to-carbon ratio of the upgraded oil feedstock may be less than heteroatom-to-carbon ratio of the oil feedstock.

A reactor may be used to upgrade oil feedstocks. The reactor includes a quantity of an oil feedstock, where the oil feedstock has at least one carbon atom and a heteroatom and/or one or more heavy metals. The reactor may also include an alkali metal. In one embodiment, the reactor includes an upgradant hydrocarbon that may include at least one carbon atom and at least one hydrogen atom. The alkali metal reacts with the heteroatom and/or the heavy metals to form one or more inorganic products. The upgradant hydrocarbon reacts with the oil feedstock to produce an upgraded oil feedstock. The number of carbon atoms in the upgraded oil feedstock is greater than the number of carbon atoms in the oil feedstock and the heteroatom-to-carbon ratio of the upgraded oil feedstock is less than the heteroatom-to-carbon ratio of the oil feedstock. The reactor need not utilize Hydrogen gas.

DETAILED DESCRIPTION

Figure 1:
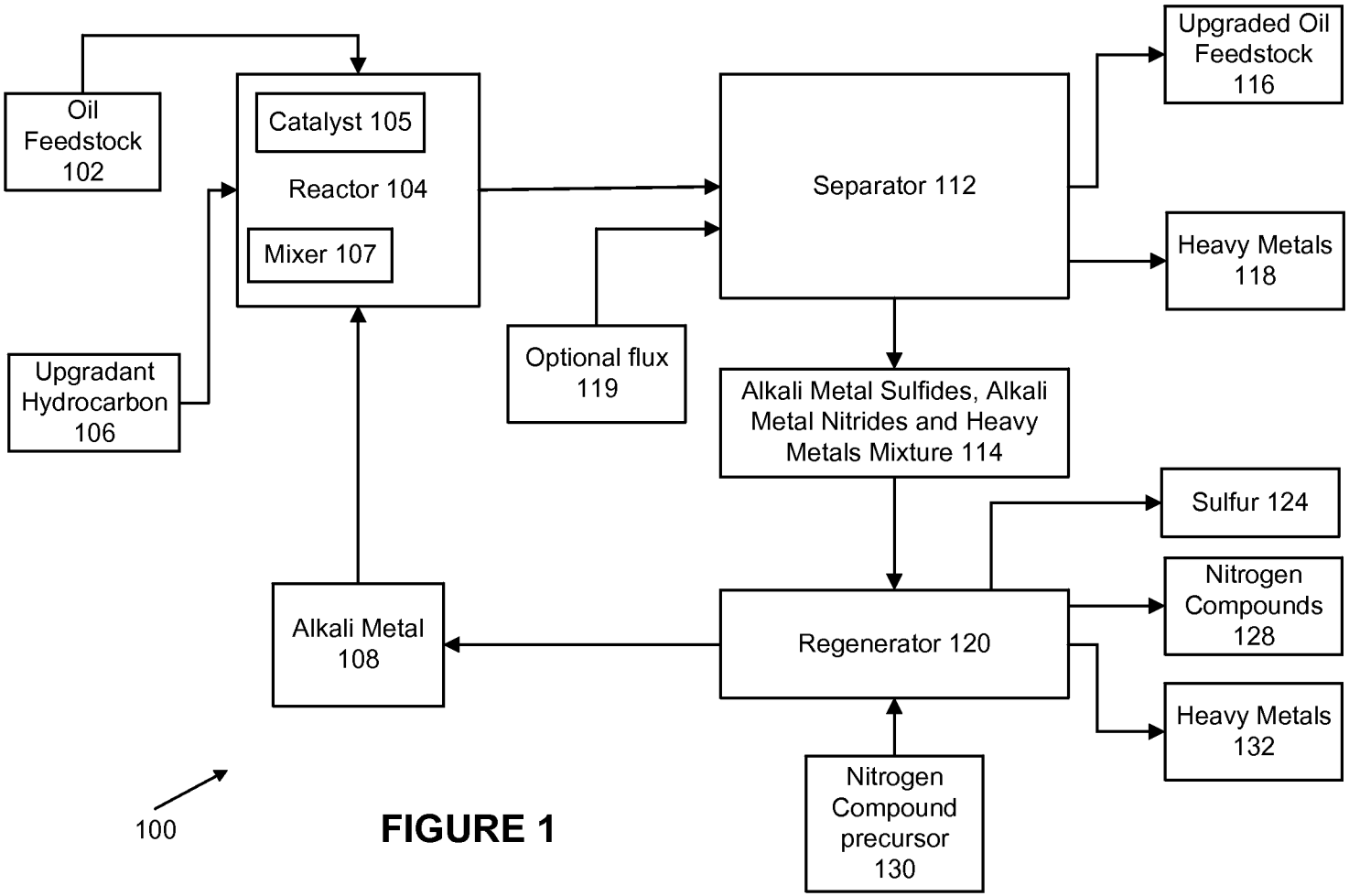
FIG. 1 is flow diagram showing one embodiment of a method of upgrading an oil feedstock.

As explained above, hydro-treating is the process by which oil feedstocks are treated to remove heteroatoms such as nitrogen, sulfur, and/or heavy metals. The hydrogen forms bonds with the carbon atoms of the oil feedstock that were previously bonded to the heteroatoms. However, a conventional hydro-treating process can be expensive to operate simply because the hydrogen gas needed for this reaction is an expensive commodity. The present embodiments however, are designed to upgrade an oil feedstock without requiring the use of hydrogen gas or emitting carbon dioxide into the atmosphere, enabling this process of upgrading the oil feedstock to greatly reduce the production cost without the harmful carbon dioxide byproduct. Likewise, the present embodiments do not require the use of water as a reactant, and thus, this process is well suited for arid climates where water is a high-priced resource. By eliminating the carbon dioxide emissions and reducing the amount of water used in the process, the present embodiments are environmentally-friendly and cost-effective.

Accordingly, the present embodiments involve a method of upgrading an oil feedstock (such as heavy oil, shale oil, bitumen, etc.) by combining the oil feedstock with an alkali metal and an upgradant hydrocarbon material. This reaction operates to remove the sulfur, nitrogen and/or heavy metals contained within the oil feedstock. The upgradant hydrocarbon used in this process, however, is not hydrogen gas ($H_2$), but instead is a hydrocarbon. Examples of the hydrocarbons that may be used include methane, ethane, propane, butane, pentane, hexane, ethene, propene, butane, pentene, dienes, and their isomers. Other hydrocarbons (such as octane, or other carbon containing compounds containing one or more carbon atoms) may also be used. The hydrocarbon gas may also be comprised of a mixture of hydrocarbon gases (such as natural gas, or shale gas—the gas produced by retorting oil shale). In many embodiments, the hydrocarbon gas may be methane from natural gas because this component is inexpensive and readily available.

In one embodiment, the hydrocarbon has at least one carbon atom and at least one hydrogen atom. The hydrogen atom should be such that it can be pulled off from the carbon atom to form a bond with the organic molecules of the feedstock. The hydrocarbon atom may include hydrogen atoms bonded therein, but the hydrocarbon molecule must include at least one carbon atom (and thus cannot comprise $H_2$ gas). The hydrocarbon may be selected such that it will increase the ratio of hydrogen to carbon in the organic product. This occurs by selecting the hydrocarbon such that the hydrocarbon has a greater hydrogen-to-carbon ratio than the starting feedstock. Of course, a lower hydrogen-to-carbon ratio in the hydrocarbon can still provide upgrading benefits if the heteroatom content is reduced.

The oil feedstock is combined with the hydrocarbon (such as methane) and the alkali metal (such as sodium) in a reactor vessel and allowed to react for a period of time. The reaction may, in some embodiments, be conducted at a temperature less than about 450° C. In one embodiment, the reaction is conducted at a temperature higher than 150° C. The reaction may be conducted at a pressure higher than about 250 psi. In one embodiment, the reaction is conducted at a pressure below about 2500. Other embodiments may be done at lower temperatures and/or lower pressures.

This process may, in some embodiments, occur in the presence of a catalyst to help promote the chemical reactions. The catalysts may include by way of non-limiting example, molybdenum, nickel, cobalt or alloys of molybdenum, alloys of nickel, alloys of cobalt, alloys of molybdenum containing nickel and/or cobalt, alloys of nickel containing cobalt and/or molybdenum, molybdenum oxide, nickel oxide or cobalt oxides and combinations thereof. Any alkali metal could be used in the process including, but not limited to, mixtures and/or alloys of alkali metals. In some embodiments, potassium, sodium, lithium and/or alloys thereof, may be used.

During this reaction, sulfur and nitrogen atoms separate from the organic molecules in the oil feedstock and combine with the alkali metal (sodium or lithium) to form sulfides and nitrides. These alkali metal sulfides/nitrides are inorganic compounds that separate into an inorganic phase that is distinct from the organic phase housing the organic compounds. A portion of the heavy metals originally contained in the organic materials, such as iron, arsenic and vanadium, are reduced and can also be separated into the inorganic phase as well. The resulting organic compounds are in the organic phase and react with the methane (upgradant hydrocarbon). The methane is a fully saturated hydrocarbon, and as such, the resulting organic compound may have a higher ratio of hydrogen to carbon than the original oil feedstock. Likewise, the resulting organic product has a greater number of carbon atoms than the original oil feedstock. (This increase in the number of carbon atoms in the carbon chain increases the overall energy of the organic product.) Further, because the heteroatoms react with the alkali metal, the resulting product has a lower heteroatom to carbon ratio than the original oil feedstock.

The alkali metal may be added to the reaction vessel because the free energy of formation of the alkali metal sulfide is greater than the free energy of formation of $H_2S$. In one embodiment, the reaction proceeds more readily with the introduction of the alkali metal. In one embodiment, the alkali metal may include sodium, lithium, or the like.

Referring now to FIG. 1, a schematic method 100 of the present embodiments for upgrading an oil feedstock is disclosed. As can be seen from FIG. 1, a quantity of oil feedstock 102 is obtained. This oil feedstock 102 may comprise bitumen, shale oil, heavy oil, or other materials described herein. The oil feedstock 102 may be obtained via mining or other processes. The oil feedstock 102 is added to a reaction vessel 104 (which is referred to herein as reactor 104). The reactor 104 may include a mixer 107 that is designed to mix (stir) the chemicals added therein in order to facilitate a reaction. A catalyst 105 of the type described above may also be added to the reactor 104 to foster the reaction.

Also added to the reactor 104 is a quantity of an alkali metal 108. This alkali metal 108 may be any alkali metal 108 and may include mixtures of alkali metals 108. In some embodiments, sodium or lithium may be used.

A quantity of a upgradant hydrocarbon 106 may also be used and added to the reactor 104. As noted above, this upgradant hydrocarbon 106 may be methane, ethane, propane, etc. or any other hydrocarbon (or even mixtures thereof). However, because of its relative inexpensive nature, natural gas or shale oil gas (which generally contains methane $CH_4$) may be used.

As noted herein, the reactor 104 may cause the reaction to occur at a certain temperature or pressure. In some embodiments, the temperature used for the reaction may be elevated up to about 450° C. One exemplary temperature may be 350° C. In some embodiments, temperatures as low as room temperature or ambient temperature may be used. In other embodiments, the temperature may be such that the alkali metal 108 is in a molten state. It will be appreciated by those of skill in the art that sodium becomes molten at about 98° C. whereas lithium becomes molten at about 180° C. Thus, embodiments may be designed in which the temperature of the reactor 104 is above room temperature, and more specifically, above the melting temperature of the alkali metal 108. The pressure of the reaction may be anywhere from atmospheric pressure and above. Some exemplary embodiments are performed at a pressure that is above about 250 psi. Other embodiment may be performed at a pressure the is below about 2500 psi.

When the temperature is elevated, the alkali metal 108 may be molten to facilitate the mixing of this chemical with the other chemicals. However, other embodiments may be designed in which a powdered or other solid quantity of the alkali metal 108 is blown into, or otherwise introduced, into the reactor 104 so that it reacts with the other chemicals.

In a reaction that occurs in the reactor 104, the heteroatoms (such as sulfur and nitrogen) and other heavy metals are removed from the oil feedstock 102. The products from the reactor 104 are then sent to a separator 112. The separator 112 may include a variety of devices/processes that are designed to separate the upgraded oil feedstock 116 from the other reaction products. The separator 112 may include filters, centrifuges and the like. The separator 112 may also receive, depending upon the embodiment, an influx of a flux 119. This flux material 119 may be hydrogen sulfide $H_2S$ or water or other chemical(s) that facilitate the separation. Mixing the treated feedstock with hydrogen sulfide to form an alkali hydrosulfide can form a separate phase from the organic phase (oil feedstock). This reaction is shown below, in which sodium (Na) is the alkali metal, although other alkali metals may also be used:

$$Na_2S+H_2S \rightarrow 2NaHS \text{ (which is a liquid at 375° C.)}$$

$$Na_3N+3H_2S \rightarrow 3NaHS+NH_3$$

The nitrogen product is removed in the form of ammonia gas ($NH_3$) which may be vented and recovered, whereas the sulfur product is removed in the form of an alkali hydro sulfide, NaHS, which is separated for further processing. Any heavy metals will also be separated out from the organic hydrocarbons by gravimetric separation techniques.

Some heavy metals 118 which were reduced from the feedstock 102 may separate here and be extracted as heavy metals 118. The separation also produces the organic product, which is the upgraded oil feedstock 116. This upgraded oil feedstock 116 may be shipped to a refinery for further processing, as needed, to make this material a suitable hydrocarbon fuel. Another output of the separator 112 is a mixture 114 (stream) of alkali metal sulfides, alkali metal nitrides, and heavy metals 118. This mixture 114 may be further processed as described below. Alternatively or additionally, any nitrogen containing products (such as via ammonia gas ($NH_3$) that is vented off and collected) may also be removed from this stage depending on the type of the process employed.

The mixture 114 of alkali metal sulfides, alkali metal nitrides, and heavy metals 118 may be sent to a regenerator 120. The purpose of the regenerator 120 is to regenerate the alkali metal 108 so that it may be reused in further processing at the reactor 104. Thus, one of the outputs of the regenerator 120 is a quantity of the alkali metal 108. In many embodiments, the regeneration step involves an electrolytic reaction (electrolysis) of an alkali metal sulfide and/or polysulfide using an ionically conductive ceramic membrane (such as, for example, a NaSiCON or LiSiCON membrane that is commercially available from Ceramatec, Inc. of Salt Lake City, Utah). These processes are known and examples of such processes are found in U.S. Pat. No. 3,787,315, U.S. Patent Application Publication No. 2009/0134040 and U.S. Patent Application Publication No. 2005/0161340 (which documents are incorporated herein by reference). The result of this electrolysis process is that sulfur 124 will be captured. Further, heavy metals 132 may be separated from the mixture 114, via the electrolysis process or other processes. In further embodiments, the nitrogen containing compounds 128 may also be collected at the regenerator 120. As noted above, such nitrogen compounds 128 may be ammonia gas that is vented off or collected. In other embodiments, nitrogen compound precursors 130 are added to the regenerator 120 to capture/react with the nitrogen containing compounds in the mixture 114 and produce the compounds 128. Those skilled in the art will appreciate the various chemicals and processes that may be used to capture the nitrogen compounds 128 (or to otherwise process the nitrogen obtained from the reaction).

The embodiment of FIG. 1 does not include a Steam-Methane Reforming Process. As noted above, the steam methane reforming process is used to generate the hydrogen and requires inputs of methane and water and outputs hydrogen gas and carbon dioxide. Hydrogen gas is not used in the method 100 (i.e., hydrogen gas is not added to the reactor 104), and as such, there is no need in this method 100 to use a Steam-Methane Reforming Process; however, this method does not preclude the utilization of hydrogen as adjunct to an upgradent hydrocarbon. Thus, carbon dioxide is not produced by the method 100 and water (as a reactant) is not required. As a result, the present method 100 may be less expensive (as it does not require water as a reactant) and may be more environmentally-friendly (as it does not output carbon dioxide into the atmosphere).

The method 100 of FIG. 1 may be run as a batch process or may be a continuous process, depending upon the embodiment. Specifically, if it is a continuous process, the reactants would be continuously added to the reactor 104 and the products continuously removed, separated, etc. Further, the reaction in the reactor 104 may be performed as a single step (e.g., placing all of the chemicals into a single reactor 104) or potentially done as a series of steps or reactions.

Figure 2:
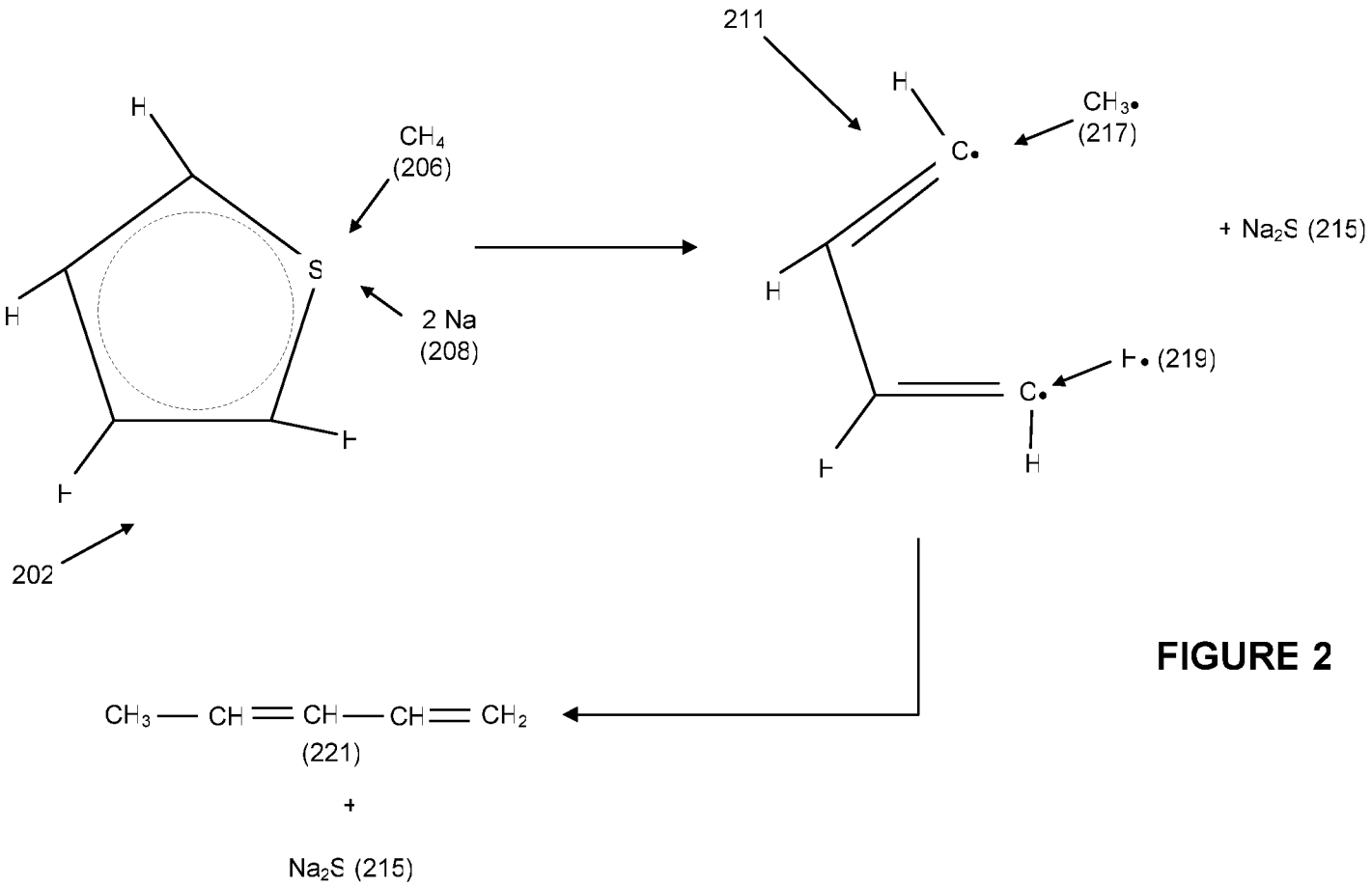
FIG. 2 illustrates a diagram of one embodiment of a chemical reaction used to upgrade the feedstock.

Referring now to FIG. 2, an example will be provided of the reaction that occurs within the reactor 104 of FIG. 1. In this example, the upgradant hydrocarbon is methane 206 (such as from natural gas) and the alkali metal is sodium 208 (although other hydrocarbons and alkali metals may be used). Further, as an example, the oil feedstock material comprises a thiophene derived product ($C_4H_4S$) 202, which is a cyclic compound that contains sulfur. One purpose of the reactions in the reactor 104 is to upgrade this $C_4H_4S$ material into a product that does not contain sulfur and is better suited for use as a hydrocarbon fuel. Another purpose of the reactions in the reactor 104 is to increase the ratio of hydrogen to carbon of the resulting organic product thereby giving the product a greater energy value.

When the $C_4H_4S$ material 202 is reacted, the sodium metal 208 reacts and extracts the sulfur atom, thereby creating a $Na_2S$ product 215. This extraction of the sulfur atom creates an organic intermediate 211 which has the formula .CHCH-CHCH. which is a radical species (having radicals on either end of the molecule). This radical intermediate 211 then reacts with radical species formed from the methane 206. Specifically, a $CH_3$. radical 217 reacts with one end of the radical intermediate 211 and an H. radical 219 reacts with the other end of the radical intermediate 211, thereby forming an organic product 221 which, in this case, is an alkene ($C_5H_8$). Of course, the $Na_2S$ product 215 is also formed and may be separated out from the desired organic product 221. The mechanism described above is provided for exemplary purposes and does not preclude the possibility of likelihood of alternative mechanisms, pathways and ultimate products formed. The $Na_2S$ 215 is in an inorganic phase that separates from the organic phase.

The overall chemical reaction for the embodiment of FIG. 2 is:

$$C_4H_4S+2Na+CH_4 \rightarrow Na_2S+C_5H_8$$

Again, it should be noted that the chemicals used in FIG. 2 are exemplary and any other chemical may be used as the oil feedstock, the upgradant hydrocarbon, or the alkali metal. Of course, if a different chemical is used as the upgradant hydrocarbon (e.g., with a different number of carbon atoms than methane), then the resulting product 221 may have a greater number of carbon atoms in the chain than that which is shown in FIG. 2.

It should be noted that the embodiment of FIG. 2 has significant advantages over a method that uses hydro-treating as a mechanism for upgrading the hydrocarbon. For example, if the same oil feedstock shown in FIG. 2 ($C_4H_4S$) 202 was used with hydrogen in a hydro-treating process (as described above), the chemical reaction of this process would be likely would require first saturation of the ring with hydrogen before reaction with the sulfur would occur resulting in higher utilization of hydrogen with the following outcome:

$$C_4H_4S+4H_2 \rightarrow H_2S+C_4H_{10}\text{ (butane)}$$

Alternatively, in the case of standard sodium desulfurization with hydrogen, the chemical reaction of this process would not require saturation of the ring with hydrogen before reaction with the sulfur would occur resulting in lower utilization of hydrogen with the following outcome:

$$C_4H_4S+2Na+H_2 \rightarrow Na_2S+C_4H_8$$

A Stream Methane Reforming process may be used to generate the hydrogen gas used in this hydro-treating reaction. Starting with thiophene, using hydrotreating, butane may be formed with a low value heat of combustion of 2654 KJ/mol but where 1.43 moles of methane were used to generate the hydrogen, where the low value heat of combustion equivalent of the methane is 1144 KJ/mol for a net of 1510 KJ/mol, and where 1.43 moles $CO_2$ where emitted generating the hydrogen and 2.86 moles water consumed. Starting with the same thiophene, using the sodium desulfurization process with hydrogen, 1,3butadiene may be generated with a low value heat of combustion of 2500 KJ/mol but where only 0.36 moles of methane were used to generate the hydrogen, where the low value heat of combustion equivalent of the methane is 286 KJ/mol for a net of 2214 KJ/mol, and where only 0.36 moles $CO_2$ where emitted generating the hydrogen and 0.72 moles water consumed. But with the present invention, starting with the same thiophene, using the sodium desulfurization process with methane for example instead of hydrogen, 1,3pentadiene may be generated with a low value heat of combustion of 3104 KJ/mol, where only 1 mole of methane was used in the process, where the low value heat of combustion equivalent of the methane is 801 KJ/mol for a net of 2303 KJ/mol, and where only no $CO_2$ is emitted or water consumed generating hydrogen. This last case which is the method disclosed in this invention results in 4% higher net energy value while at the same time reduces harmful emissions and reduces water utilization compared to the prior art.

In an alternative case, the hydrogen for the hydro-treating process may be supplied by electrolysis of water (as describe above). Assuming that the electrolysis process is 90% efficient and the upgrading process is 100% efficient, the outcome of upgrading thiophene to an upgraded oil product (butane ($C_4H_{10}$)) having a combustion energy equivalent of 2654 kJ/mole. However, the electrical energy required for the electrolysis process to form the hydrogen (assuming no losses in generation or transmission) is 1200 kJ/mole of thiophene. Thus, the net combustion value of upgrading thiophene using hydrogen from electrolysis is 1454 kJ/mole (e.g., 2654−1200). At the same time, four moles of water were consumed per mole of thiophene in making this product. Alternatively, using standard sodium desulfurization with hydrogen generated by electrolysis, to form $C_4H_8$ having a combustion energy equivalent of 2500 kJ/mole. However, the electrical energy required for the electrolysis process to form the hydrogen (assuming no losses in generation or transmission) is 300 kJ/mole of thiophene. Thus, the net combustion value of upgrading thiophene using hydrogen from electrolysis is 2200 kJ/mole (e.g., 2500−300). At the same time, one mole of water was consumed per mole of thiophene in making this product.

However, the process of FIG. 2, which upgrades the $C_4H_8S$ with methane rather than $H_2$, produces a pentadiene ($C_5H_{10}$) product and is more efficient. 1,3Pentadiene has a combustion energy equivalent of 3104 kcal/mole (which is much higher than 1,3butadiene). The combustion value of the methane that was consumed in the reaction of FIG. 2 was 801 kJ/mol. The net combustion value for the feedstock produced in FIG. 2 was 2303 kcal/mol (e.g., 3104−801). Again, the net combustion value for the production of 1,3butadiene via hydrogen from a steam methane reforming process was 2214 kJ/mole, and the embodiment of FIG. 2 provides an additional 89 kJ of energy per mole oil feedstock (e.g., 2303−2214) when the hydrogen is produced from steam methane reforming. This is about a 4.0% increase in net energy, while at the same time using less water resources and emitting no carbon dioxide into the environment. If the hydrogen for the sodium desulfurization process was produced via electrolysis, the increase of the net combustion value for the oil feedstock is 103 kcal of energy per mole oil feedstock (e.g., 2303−2200). This is about a 4.7% increase in net energy, without consuming the water resources in the reaction. Thus, it is apparent that the present embodiments result in an upgraded oil feedstock that has a greater net energy value while at the same time using less water and not emitting carbon dioxide into the environment. Clearly, this is a significant advantage over hydrotreating or the prior art sodium desulfurization with hydrogen regardless of whether the hydrogen is produced by electrolysis or steam methane reforming.

It should also be noted that the present embodiments have a further advantage in that there are less capital expenditures required to create a working process. Specifically, the industrialist does not have to expend the thousands of dollars to obtain a quantity of hydrogen gas (or build a facility that creates hydrogen gas via electrolysis or the Steam Methane Reforming process). Further, the maintenance costs of running the method 100 may be lower because there is no electrolysis process or Steam Methane Reforming process (to produce hydrogen gas) involved in the system.

EXAMPLE 1

A feedstock oil was derived (extracted) from the Uintah Basin in Eastern Utah, USA. This oil feedstock comprised shale oil containing sulfur and nitrogen. This oil feedstock was centrifuged to remove any solids found therein. The centrifuged oil feedstock had the following composition:

| % Carbon in Shale Oil | % Hydrogen in Shale Oil | % Nitrogen in Shale Oil | % Sulfur in Shale Oil | Hydrogen-to-Carbon Ratio | Nitrogen-to-Carbon Ratio | Sulfur-to-Carbon Ratio |
|---|---|---|---|---|---|---|
| 84.48 | 12.33 | 1.48 | 0.25 | 0.146 | 0.0175 | 0.0030 |

179.2 grams of the centrifuged shale oil was combined with 6 grams of sodium metal in a reactor vessel. The shale oil was blanketed with methane gas to 113 pounds per square inch absolute pressure (7.68 atmospheres) and then heated to 150° C. Once at 150° C., the pressure of the vessel was increased to 528 pounds per square inch absolute pressure (35.9 atmospheres) for 1 hour. After 1 hour, the heat source was removed from the reactor vessel and the vessel was cooled to room temperature. After cooling, the pressure in the vessel was released.

The reacted mixture included a liquid phase and a solid phase. The liquid phase was separated from the solid phase by centrifugation. The resulting reacted oil had the following composition in terms of Carbon, Hydrogen, Nitrogen and Sulfur and composition:

| % Carbon in Product | % Hydrogen in Product | % Nitrogen in Product | % Sulfur in Product | Hydrogen-to-Carbon Ratio in Product | Nitrogen-to-Carbon ratio in Product | Sulfur-to-Carbon Ratio in Product |
|---|---|---|---|---|---|---|
| 85.04 | 12.83 | 0.68 | 0.15 | 0.151 | 0.0080 | 0.0018 |

As can be seen from this example, the reaction with methane lowered the amount of nitrogen in the product. Thus, the ratio of nitrogen to carbon in the end product is much less than it was in the original shale oil. In fact, the reduction in the nitrogen-to-carbon ratio was about 54.4%. Similarly, the amount of sulfur in the end product is much less after the reaction with methane. Accordingly, the ratio of sulfur to carbon in the end product is much less than it was in the original shale oil. The reduction in the sulfur-to-carbon ratio was about 40.4%. Further, the percentage of hydrogen in the end product is greater than it was in the unreacted shale oil and thus, the hydrogen-to-carbon ratio of the end product has also increased by 3.4%.

In addition to the reduction in nitrogen and sulfur content, the American Petroleum Institute gravity ("API gravity") of the original shale oil was 35.29. (API gravity is a measure of how heavy or light a petroleum liquid is compared to water. If its API gravity is greater than 10, it is lighter than water and floats on water, whereas if the API gravity is less than 10, it is heavier and sinks in water. API gravity is an inverse measure of the relative density of the petroleum liquid and is used to compare the relative densities of petroleum liquids.) After the reaction, however, the API gravity increased to 39.58. This increase is the API gravity indicates an upgrading of the shale oil after the reaction.

Figure 3:
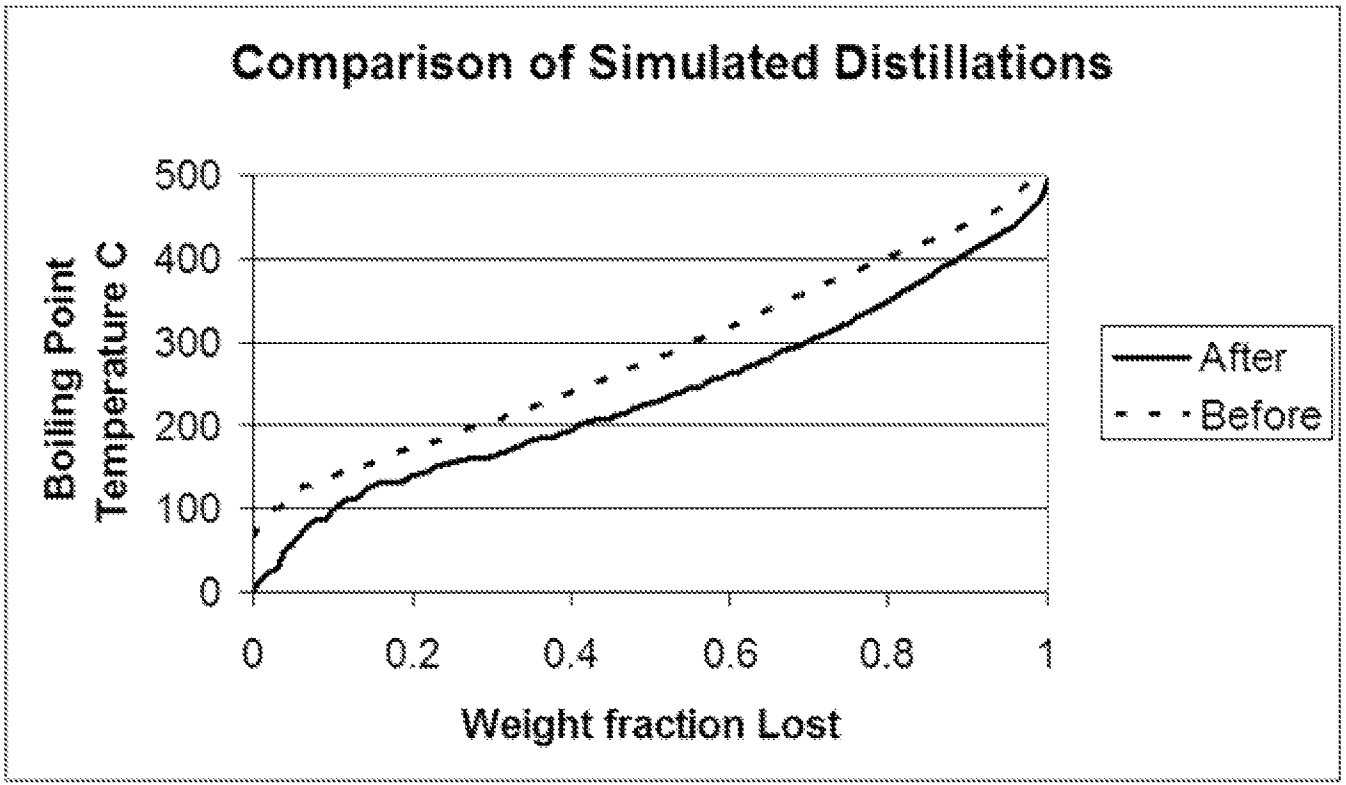
FIG. 3 shows a plot of Boiling Point temperatures versus Weight Fraction Lost of a shale oil before and after the reaction described in the present embodiments.

The oil produced from the above-described reaction was also analyzed by a gas chromatograph and a simulated distillation was determined. FIG. 3 shows a plot of Boiling Point temperatures versus Weight Fraction Lost of the oil before and after the reaction. The average difference in Boiling Point before and after the treatment was 45.7° C. This decrease in the simulated boiling point temperature also indicates an upgrading of the shale oil after the reaction.

The reduction in nitrogen and sulfur content, the increase in hydrogen content, the increase in API gravity, and the decrease in boiling point temperature are all indications of an upgrading of the oil without using a conventional hydrotreating process and without using any hydrogen.

EXAMPLE 2

A feedstock oil was derived (extracted) from the Uintah Basin in Eastern Utah, USA. This oil feedstock comprised shale oil containing sulfur and nitrogen. This oil feedstock was centrifuged to remove any solids found therein. The centrifuged oil feedstock had the following composition:

| % Carbon in Shale Oil | % Hydrogen in Shale Oil | % Nitrogen in Shale Oil | % Sulfur in Shale Oil | Hydrogen-to-Carbon Ratio | Nitrogen-to-Carbon Ratio | Sulfur-to-Carbon Ratio |
|---|---|---|---|---|---|---|
| 84.48 | 12.33 | 1.48 | 0.25 | 0.146 | 0.0175 | 0.0030 |

179.2 grams of the centrifuged shale oil was combined with 6 grams of sodium metal in a reactor vessel. The shale oil was blanketed with methane gas to 113 pounds per square inch absolute pressure (7.68 atmospheres) and then heated to 375° C. Once at 375° C., the pressure of the vessel was increased to 528 pounds per square inch absolute pressure (35.9 atmospheres) for 1 hour. After 1 hour, the heat source was removed from the reactor vessel and the vessel was cooled to room temperature. After cooling, the pressure in the vessel was released.

The reacted mixture included a liquid phase and a solid phase. The liquid phase was separated from the solid phase by centrifugation. The resulting reacted oil had the following composition in terms of Carbon, Hydrogen, Nitrogen and Sulfur and composition:

| % Carbon in Product | % Hydrogen in Product | % Nitrogen in Product | % Sulfur in Product | Hydrogen-to-Carbon Ratio in Product | Nitrogen-to-Carbon ratio in Product | Sulfur-to-Carbon Ratio in Product |
|---|---|---|---|---|---|---|
| 85.72 | 12.51 | 0.71 | 0.06 | 0.146 | 0.0083 | 0.0007 |

As can be seen from this example, the reaction with methane lowered the amount of nitrogen in the product. Thus, the ratio of nitrogen to carbon in the end product is much less than it was in the original shale oil. In fact, the reduction in the nitrogen-to-carbon ratio was about 52.7%. Similarly, the amount of sulfur in the end product is much less after the reaction with methane. Accordingly, the ratio of sulfur to carbon in the end product is much less than it was in the original shale oil. The reduction in the sulfur-to-carbon ratio was about 76.3%.

The oil produced from the above-described reaction was also analyzed by a gas chromatograph and a simulated distillation was determined. FIG. 3 shows a plot of Boiling Point temperatures versus Weight Fraction Lost of the oil before and after the reaction. The average difference in Boiling Point before and after the treatment was 25.7° C. This decrease in the simulated boiling point temperature also indicates an upgrading of the shale oil after the reaction.

The reduction in nitrogen and sulfur content, and the decrease in boiling point temperature are all indications of an upgrading of the oil without using a conventional hydro-treating process and without using hydrogen at all.

EXAMPLE 3

A different feedstock oil was derived (extracted) from a different part of the Uintah Basin in Eastern Utah, USA. This oil feedstock comprised shale oil containing sulfur and nitrogen. This oil feedstock was centrifuged to remove any solids found therein. The centrifuged oil feedstock had the following composition:

| % Carbon in Shale Oil | % Hydrogen in Shale Oil | % Nitrogen in Shale Oil | % Sulfur in Shale Oil | Hydrogen-to-Carbon Ratio | Nitrogen-to-Carbon Ratio | Sulfur-to-Carbon Ratio |
|---|---|---|---|---|---|---|
| 84.83 | 12.74 | 0.47 | 0.84 | 0.150 | 0.006 | 0.010 |

179.2 grams of the centrifuged shale oil was combined with 6 grams of sodium metal in a reactor vessel. The shale oil was blanketed with methane gas to 113 pounds per square inch absolute pressure (7.68 atmospheres) and then heated to 375° C. Once at 375° C., the pressure of the vessel was increased to 528 pounds per square inch absolute pressure (35.9 atmospheres) for 1 hour. After 1 hour, the heat source was removed from the reactor vessel and the vessel was cooled to room temperature. After cooling, the pressure in the vessel was released.

The reacted mixture included a liquid phase and a solid phase. The liquid phase was separated from the solid phase by centrifugation. The resulting reacted oil had the following composition in terms of Carbon, Hydrogen, Nitrogen and Sulfur and composition:

| % Carbon in Product | % Hydrogen in Product | % Nitrogen in Product | % Sulfur in Product | Hydrogen-to-Carbon Ratio in Product | Nitrogen-to-Carbon ratio in Product | Sulfur-to-Carbon Ratio in Product |
|---|---|---|---|---|---|---|
| 85.95 | 13.06 | 0.25 | 0.03 | 0.152 | 0.0029 | 0.0003 |

As can be seen from this example, the reaction with methane lowered the amount of nitrogen in the product. Thus, the ratio of nitrogen to carbon in the end product is much less than it was in the original shale oil. In fact, the reduction in the nitrogen-to-carbon ratio was about 47.5%. Similarly, the amount of sulfur in the end product is much less after the reaction with methane. Accordingly, the ratio of sulfur to carbon in the end product is much less than it was in the original shale oil. The reduction in the sulfur-to-carbon ratio was about 96.5%. Also the ratio of hydrogen to carbon in the product increased by 1.2% compared to the feedstock.

The reduction in nitrogen and sulfur content, and increase in hydrogen content are indications of an upgrading of the oil without using a conventional hydro-treating process.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method of upgrading an oil feedstock comprising:

obtaining a quantity of an oil feedstock, the oil feedstock comprising at least one carbon atom and a heteroatom and/or one or more heavy metals;

reacting the quantity of the oil feedstock with an alkali metal and an upgradant hydrocarbon, wherein the upgradant hydrocarbon comprises at least one carbon atom and at least one hydrogen atom, wherein the alkali metal reacts with the heteroatom and/or the one or more heavy metals to form one or more inorganic products, wherein the upgradant hydrocarbon reacts with the oil feedstock to produce an upgraded oil feedstock, wherein the number of carbon atoms in the upgraded oil feedstock is greater than the number of carbon atoms in the oil feedstock; and separating the inorganic products from the upgraded oil feedstock.

2. The method as in claim 1, wherein the alkali metal comprises lithium, sodium and/or alloys thereof.

3. The method as in claim 1, wherein the upgradant hydrocarbon comprises natural gas, shale gas and/or mixtures thereof.

4. The method as in claim 1, wherein the upgradant hydrocarbon comprises methane, ethane, propane, butane, pentane, ethene, propene, butene, pentene, dienes, isomers of the forgoing, and/or mixtures thereof.

5. The method as in claim 1, wherein the reacting occurs at a pressure greater than about 250 psi.

6. The method as in claim 1, wherein the reacting occurs at a pressure less than about 2500 psi.

7. The method as in claim 1, wherein the reaction occurs at a temperature greater than about room temperature.

8. The method as in claim 1, wherein the reaction occurs at a temperature less than about 450° C.

9. The method as in claim 6, wherein the reaction occurs at a temperature that is greater than the melting point of the alkali metal but is lower than 450° C.

10. The method as in claim 1, wherein a catalyst is used in the reaction, wherein the catalyst is comprised of molybdenum, nickel, cobalt or alloys thereof, molybdenum oxide, nickel oxide or cobalt oxides and combinations thereof.

11. The method as in claim 1, wherein separation occurs in a separator, wherein the inorganic products form a phase that is separable from an organic phase that comprises the upgraded oil feedstock.

12. The method as in claim 11, further comprising adding a flux to the separator.

13. The method as in claim 1, wherein the reaction among the quantity of the oil feedstock, the alkali metal, and the upgradant hydrocarbon molecule does not use hydrogen gas.

14. The method as in claim 1, wherein a ratio of hydrogen to carbon in the upgraded oil feedstock is greater than a ratio of hydrogen to carbon in the oil feedstock.

15. The method as in claim 1, wherein the upgraded oil feedstock has a greater energy value than the oil feedstock.

16. The method as in claim 1, wherein a heteroatom to carbon ratio of the upgraded oil feedstock is less than a heteroatom to carbon ratio of the oil feedstock.

17. The method as in claim 1, wherein the method further comprises regenerating the alkali metal from the inorganic products.

* * * * *